United States Patent [19]

Cadawas

[11] 4,145,571

[45] Mar. 20, 1979

[54] LOUDSPEAKER ENCLOSURE WITH ACOUSTICALLY COUPLED LOUDSPEAKER DAMPER

[76] Inventor: Thomas L. Cadawas, 92 Oneida Ave., Staten Island, N.Y. 10301

[21] Appl. No.: 886,057

[22] Filed: Mar. 13, 1978

[51] Int. Cl.[2] ..... H04R 1/28

[52] U.S. Cl. ..... 179/1 E; 179/180

[58] Field of Search ..... 179/1 E, 180

[56] References Cited

U.S. PATENT DOCUMENTS 3,275,758 9/1966 Bryan et al. ..... 179/180

FOREIGN PATENT DOCUMENTS 1095563 6/1955 France ..... 179/1 E 4426140 11/1969 Japan ..... 179/1 E

*Primary Examiner*—George G. Stellar

*Attorney, Agent, or Firm*—Jacobs & Jacobs

[57] ABSTRACT

A loudspeaker system is described in which a driven speaker is acoustically coupled in the speaker enclosure with a variable acoustical damper, the damper having an acoustical cone, the movement of which is dampened by an induction coil connected across variable resistance means.

2 Claims, 3 Drawing Figures

LOUDSPEAKER ENCLOSURE WITH ACOUSTICALLY COUPLED LOUDSPEAKER DAMPER

The present invention pertains to improvements in loudspeaker components.

The desirability of suppressing mechanical resonance of an enclosed loudspeaker, in particular enclosure resonance, is well recognized. One approach to this problem has centered about the enclosure for the loudspeaker, it being known that a poorly constructed enclosure or one that is of inadequate size for speakers producing base and lower mid-frequencies will result in poor reproduction. Moreover, if the interior of the enclosure is not properly damped, the volume level at resonance frequency is excessive. Accordingly, the interior of loudspeaker enclosures is generally lined with material such as fiberglass or dense cellulose material in order to absorb the acoustical energy within the enclosure.

In addition, it has been proposed that the mechanical resonance of a loudspeaker can be suppressed through the incorporation of a motional feedback amplifier in which the feedback is generated by an impedance bridge with the loudspeaker constituting one arm thereof and which is balanced when the loudspeaker's diaphragm is blocked. Such circuitry can add considerable cost to the speakers and, as is noted in U.S. Pat. No. 3,647,969, realization of the theoretical advantages of such a system has not been possible on a practical scale.

Among the objects of the present invention, therefore, is to provide a loudspeaker damper acoustically coupled to a driven loudspeaker and in which the degree of damping can be readily adjusted to accommodate varying environments. Further objects of the invention include the reduction and suppression of enclosure resonance and frequency modulation distortion, the improvement in transient response, efficiency, low frequency response and dynamic range, the elimination of over excursion of the driven speaker and the possibility of reducing the size of the speaker enclosure, the reduction or elimination of other damping materials and an overall reduction in the cost of labor and materials for construction of the speaker system. The invention is particularly valuable in improving acoustical efficiency at low frequencies; i.e. below 60 Hz. In addition, the present invention is responsive to the Fletcher-Munson effect, the degree of damping changing the variations in frequency resulting from volume changes. Other objects of the invention will be apparent from the following discussion and the drawings in which:

Figure 1:
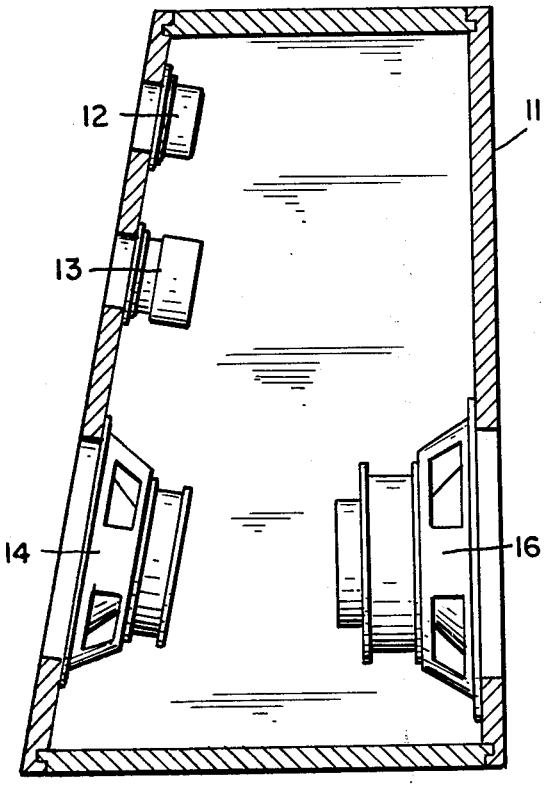
FIG. 1 is a cross-section of a loudspeaker cabinet embodying conventional driven speakers and a variable acoustical damper.
Figure 2:
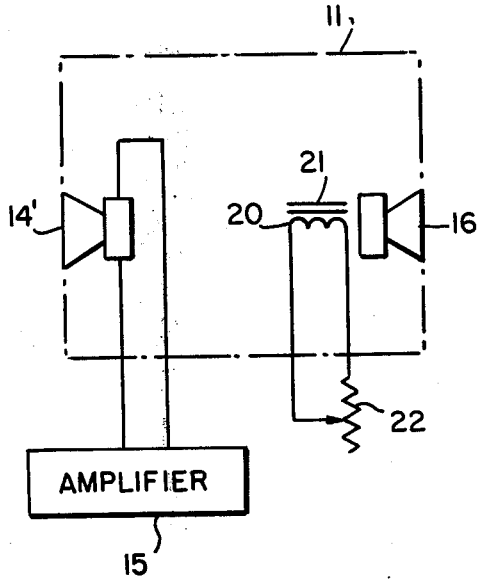
FIG. 2 is a schematic view of the individual circuits.

Referring now in greater detail to the drawings, there is shown in FIG. 1 a speaker system comprising an enclosure 11 in which is mounted one or more driven speakers such as tweeter 12, mid-range speaker 13 and woofer or low frequency speaker 14. Speakers 12, 13 and 14 are mounted in enclosure 11 in a conventional manner and, as shown in FIG. 2 for speaker 14', connected electrically to an amplifier 15, again in a conventional manner.

Also mounted within enclosure 11 is the acoustical damper 16. It will be noted that damper 16 is acoustically coupled to the other speakers by reason of the air entrapped within enclosure 11 and is tuned to the resonant frequency of the enclosure.

Figure 3:
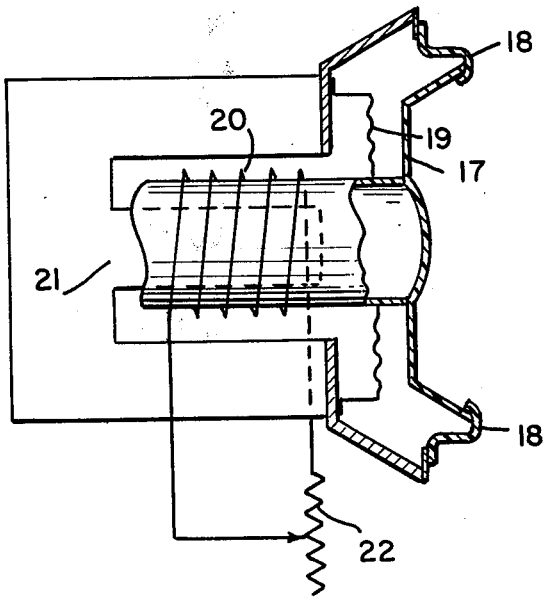
FIG. 3 is a cross-section of the variable acoustical damper.

As can be seen from FIG. 3, the construction of the damper is similar to that of a conventional speaker and, indeed, a conventional speaker can be suitably modified to be utilized as this component. The damper thus includes cone 17 suspended by cone surround 18 and spider 19. In the embodiment shown in FIG. 3, induction coil 20 is responsive to oscillations of cone 17 and such movements with respect to magnetic core 21 generates an induction current across variable resistor 22. The degree of damping is determined by the amount of resistance afforded by variable resistor 22. At the maximum resistance setting, which will generally be in the range of about 100 ohms, substantially no induction current will flow and no damping of the oscillations of cone 17 will occur (a condition which is also possible to achieve through the incorporation of a simple switch opening the induction current circuit). On the other hand, a reduction in the resistance across the variable resistor 22 will result in an increase in the induced current and the oscillations of the cone will thus be dampened in accordance with Lenz's law. It is thus possible to adjust the degree of damping, depending upon the environment in which the speaker is situated; e.g. depending upon whether the speaker is located in a small or large room.

Referring again to FIG. 3, it is desirable that cone 17 be relatively massive but mounted in spider 19 and suspension 18 so as to have a very high acoustical compliance suspension. The suspension's stiffness of the acoustical damper should be significantly less than that of the lowest frequency driven speaker; e.g. on the order of magnitude of one-tenth of the stiffness in free air.

When the low frequency driven speaker is energized with average transients, the acoustic coupling within the enclosure 11 will cause cone 17 to oscillate and variable resistor 22 can be said to provide average damping action. During transients of very large amplitude, and without any change in the setting of the variable resistor, the induced currents in the coil will increase by reason of the greater movement of coil 20 relative to magnetic core 21. Consequently, damping will automatically increase during such transients. On soft transients, on the other hand, the movement of coil 20 will be less, resulting in less induced currents and therefore less than average damping. Thus at one setting of variable resistor 22, the damper detects the motion of the low frequency driver and provides increased damping during rapid transients of large amplitude. By varying the setting of variable resistor 22, the efficiency of the low frequency driven speaker can be controlled so as to increase or decrease the amount of damping in order to compensate for the acoustical resonance and standing wave problems of a given room. The variable acoustic damper is not passive. Since it is tuned to the resonance of the enclosure and has an acoustical compliance many times greater than that of the low frequency driven speaker, the damper is actually working harder than the driven speaker.

It can thus be seen that utilization of the present invention eliminates the need for the incorporation of a motional feedback amplifier circuit as in U.S. Pat. No. 3,647,969, eliminates or greatly reduces the need for incorporating damping materials which physically suppress enclosure resonance and permits a reduction in the enclosure size for the same acoustical power. Not only is the frequency response at the lower frequencies extended without coloration, spurious resonance of the low frequency driver is reduced or eliminated.

The foregoing description and drawings represent a typical embodiment of the present invention but are not intended as limitations on the scope thereof, it being apparent that the invention can be practiced through obvious modifications and rearrangements without departing from the essential spirit thereof.

What is claimed is:

1. A loudspeaker system comprising an enclosure, at least one driven speaker mounted in said enclosure, and a variable acoustical damper mounted in said enclosure, said system being internally sealed so that said speaker and damper are acoustically coupled, said damper comprising a suspended acoustical cone having a high acoustical compliance and an acoustical stiffness significantly less than said driven speaker, and an induction coil and magnetic core, said coil being linked to said cone so as to move over said core in response to oscillations of said cone, said system further comprising variable resistance means connected across said induction coil and operable to selectively vary the induction current generated in said coil upon oscillation of said cone.

2. A loudspeaker system according to claim 1 wherein the acoustical stiffness of said damper is at least 1/10 that of the driven speaker of lowest frequency.

* * * * *